US007066142B2

(12) United States Patent
Hanasato

(10) Patent No.: US 7,066,142 B2
(45) Date of Patent: Jun. 27, 2006

(54) MULTIPLE THROTTLE APPARATUS

(75) Inventor: Maki Hanasato, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 11/077,293

(22) Filed: Mar. 11, 2005

(65) Prior Publication Data

US 2005/0155571 A1 Jul. 21, 2005

Related U.S. Application Data

(63) Continuation of application No. PCT/JP03/11611, filed on Sep. 11, 2003.

(30) Foreign Application Priority Data

Sep. 11, 2002 (JP) ..... 2002-266059

(51) Int. Cl.
*F02D 9/16* (2006.01)

(52) U.S. Cl. ..... 123/336; 123/337

(58) Field of Classification Search ..... 123/336, 123/337, 308, 432

See application file for complete search history.

(56) References Cited

U.S. PATENT DOCUMENTS 5,027,769 A * 7/1991 Yoshida et al. ..... 123/399
5,036,816 A * 8/1991 Mann ..... 123/361
5,063,899 A * 11/1991 Hitomi et al. ..... 123/336
6,622,695 B1 * 9/2003 Kondo ..... 123/336

FOREIGN PATENT DOCUMENTS

JP 58-90337 6/1983

OTHER PUBLICATIONS

Hideki Obayashi et al., Patent Abstracts of Japan, "Intake Air Control Device For Internal Combustion Engine", Publication No.: 05-248247, Publication Date: Sep. 24, 1993.
Kenzo Watanabe, Patent Abstracts of Japan, "Intake-Air Controller For Engine", Publication No.: 11-013493, Publication Date: Jan. 19, 1999.
Naoya Yamaguchi et al., Patent Abstracts of Japan, "Throttle Control Device For Engine", Publication No.: 2002-256896, Publication Date: Sep. 11, 2002.
Masaaki Matsuura et al., Patent Abstracts of Japan, "Controller For Multi-Carburetor", Publication No.: 57-056636, Publication Date: Apr. 5, 1982.

* cited by examiner

*Primary Examiner*—Erick Solis

(57) ABSTRACT

A multiple throttle apparatus has a plurality of throttle valves respectively disposed at each air intake passage corresponding to each cylinder of an engine, a plurality of throttle shafts to support the plurality of throttle valves for each group, and a plurality of drive elements to respectively drive the throttle shafts. With this structure, open-close control of one group of the throttle valves and of the other group of throttle valves can be performed separately. Therefore, the combustion condition, namely the power, can adequately be controlled in accordance with the driving conditions, and fine control, even to perform ISC, is possible. In this manner, it becomes possible to obtain electronic control and fine control to a multiple throttle apparatus of an engine mounted on a motorcycle.

17 Claims, 6 Drawing Sheets

MULTIPLE THROTTLE APPARATUS

CROSS-REFERENCE TO RELATED APPLICATIONS

This application is a continuation, filed under 35 U.S.C. §111(a), of PCT international application No. PCT/JP2003/11611, filed Sep. 11, 2003. This application claims the priority benefit of Japanese patent application No. 2002-266059, filed Sep. 11, 2002, and PCT international application No. PCT/JP2003/11611, filed Sep. 11, 2003, the disclosures of which are incorporated herein by reference.

BACKGROUND OF THE INVENTION

The present invention relates to a multiple throttle apparatus to open and close a plurality of throttle valves which are disposed at the air intake passage of an engine. More particularly, it relates to a multiple throttle apparatus having a throttle valve at an air intake passage of each cylinder of an engine which is mounted on a motorcycle, or other high performance engine vehicle.

As a conventional throttle apparatus mounted on a four-wheel car, an electronically controlled throttle apparatus or a wire-operated and electronically controlled throttle apparatus are known.

For example, the structure of a wire-operated and electronically controlled throttle apparatus is disclosed in Japanese Patent Laid-open H6-207535 as follows. With the air intake unit for a six-cylinder V-type engine comprising two surge tanks which collect the air intake passages provided for each cylinder three each and air intake passages extending upstream from each surge tank, two throttle valves disposed at each upstream air intake passage are linked with a single throttle shaft and driven by a single wire to open and close. Then, when traction control is performed, the throttle valves are driven by a single motor to the closing direction.

For another example and as disclosed in Japanese Patent Laid-open H8-218904, there is a throttle apparatus, with throttle valves each respectively disposed to two air intake passages which are formed in a throttle body and linked so as to be free to pivot with a throttle shaft and driven to open and close by a motor which is disposed at an end side of the throttle shaft.

With the above-mentioned apparatus, since the conventional throttle apparatus is disposed at the upstream side of a surge tank or the upstream side of a relatively long air intake passage, the air controlled by an open and close operation of the throttle valve flows into an air intake passage (an air intake port) corresponding to each cylinder after being stored in a surge tank or after passing through a long intake passage. Therefore, air amount flowing into an engine cylinder does not change much in accordance with a small open and close movement of the throttle valve. Accordingly, a fine open and close control is not effective.

On the other hand, as a throttle apparatus which is mounted on a motorcycle, or other such like high performance engine vehicle, a multiple throttle apparatus is known because the responsibility of throttle operation is considered important. With this apparatus, a throttle valve is disposed to each air intake passage corresponding to each cylinder (each air intake port) at the position close to the air intake port of a cylinder head. Each throttle shaft supporting each throttle valve free to pivot is linked together with synchronize levers, urge springs, and so on to transmit torque, and all throttle valves are driven to open and close by a single wire.

Further, to perform idle speed control (ISC) of the engine, a separate ISC valve is disposed to or associated with this apparatus.

By the way, even for an engine mounted to a motorcycle, etc. an electronic control which drives a plurality of throttle valves with a motor is contemplated. Further, it is also contemplated to eliminate a separate ISC valve by controlling idle speed with fine adjustment of the opening angle of the throttle valve.

Further, throttle operation of a motorcycle is more sensitive than that of a four-wheel car and is accompanied with rapid changes. Therefore, it is desired to ensure safe driving without rapid drive operation, etc. by controlling power at adequate conditions while improving performance, even in a situation when the driver mishandles the throttle or when the road conditions, etc. are poor.

SUMMARY OF THE INVENTION

One aspect of the present invention is to overcome the problems of the above-mentioned circumstances of the related art. Another aspect of the present invention is to provide a multiple throttle apparatus which is suitable for a high performance engine, especially engines mounted on motorcycles, etc. Namely, to open and close a plurality of throttle valves disposed at each air intake passage respectively by a motor, the power is adequately controlled in accordance with the driving conditions, etc. while achieving excellent drivability and safe driving.

The multiple throttle apparatus, in accordance with an embodiment of the present invention, comprises a plurality of throttle valves respectively disposed at each air intake passage corresponding to each cylinder of an engine, a throttle shaft supporting to open and close the plurality of throttle valves, and a drive unit to rotate the throttle shaft, wherein the plurality of throttle valves are separated into a plurality of groups, the throttle shaft includes a plurality of throttle shafts disposed in a line while supporting the throttle valves for each group, and the drive unit includes a plurality of drive units being disposed to exert drive force to the inner end portion of the side where the plurality of throttle shafts face each other.

With this structure, the throttle valves are separated into groups and the throttle shafts supporting the throttle valves for each group are respectively controlled to rotate by each drive unit. Therefore, the combustion condition, namely the power, can be adequately controlled in accordance with the driving conditions, and similar control can be possible even to perform idle speed control. Further, the plurality of throttle shafts are disposed in a line, receiving the drive force at the inner end portion of the side where the throttle shafts face each other. Therefore, each drive unit is aggregated around the center range of the apparatus, and the apparatus becomes compact in width and size.

In the above-mentioned structure, it is possible to respectively dispose an angle detect sensor at the outer end portion of each of the plurality of throttle shafts to detect the opening angle of the throttle valve.

With this structure, the rotate angle of the throttle shaft supporting the throttle valves for each group is detected by the angle detect sensor. Therefore, the angle of the throttle valves can be adjusted finely and accurately by each drive unit, and the combustion condition, namely the power, can be adequately controlled in accordance with the driving conditions.

In the above-mentioned structure, it is possible to separately control the plurality of drive unit in accordance with the driving conditions of an engine.

With this structure, when two drive unit are disposed for example, it is possible that one drive unit is controlled based on the accelerator operation, and the other drive unit is controlled in accordance with control signals which are determined based on the driving conditions and the accelerator operation. It is also possible that only one drive unit is controlled for idle-speed-up (fast-idle) at starting. Further, it is also possible to control the drive unit completely separately by respective computers or controllers exclusively prepared for each drive unit. Therefore, starting, controllability, specific fuel consumption, safety, etc. of the engine can be improved.

In the above-mentioned structure, it is possible that at least one of the plurality of drive units is controlled to open and close a throttle valve, and after a specific time, another one of plurality of drive units is controlled to open and close a throttle valve.

With this structure, since it is possible to suppress rapid revolution speed change of the engine even when the throttle is returned quickly, safe driving is ensured.

In the above-mentioned structure, it is possible that at least one of the plurality of groups of the throttle valves is controlled to be at a specific angle in accordance with the driving conditions of the engine.

Here, the throttle valves of one group are kept constant while the throttle valves of another group are controlled to open and close. Consequently, one group and the other group can be controlled separately. Therefore, by controlling to open and close the throttle valves for each group, adequate air amount can be supplied according to the combustion conditions of the engine which differ for each cylinder.

In the above-mentioned structure, it is possible that the specific angle is the angle to which the throttle valve is controlled while revolution speed of an engine is low.

With this structure, it is possible to operate only one drive unit to perform fine adjustment of the throttle opening when the engine speed is low. In this manner, it is possible to select an adequate angle of the throttle valve in accordance with the driving conditions.

The multiple throttle apparatus, in accordance with another embodiment of the present invention, comprises a plurality of throttle valves respectively disposed at each air intake passage corresponding to each cylinder of an engine, a throttle shaft supporting to open and close the plurality of throttle valves, and a drive unit to rotate the throttle shaft, wherein the plurality of throttle valves are separated into a plurality of groups, the throttle shaft includes a plurality of throttle shafts disposed in parallel while supporting the throttle valves for each group, and the drive unit includes a plurality of drive units to exert drive force to each of the plurality of throttle shafts, and one drive unit of the plurality of drive units is disposed to exert drive force to an end portion of one throttle shaft at one end side of two adjacent throttle shafts of the plurality of throttle shafts, and another drive unit of the plurality of drive units is disposed to exert drive force to an end portion of the other throttle shaft at the other end side of the two adjacent throttle shafts of the plurality of throttle shafts.

With this structure, for a V-type engine which cylinders are disposed in V-shape, the drive units are respectively disposed in good balance at both sides, namely one end side and the other end side of the two adjacent throttle shafts out of the plurality of throttle shafts. Therefore, the entire apparatus becomes compact in width and size.

In the above-mentioned structure, it is possible that the plurality of drive units respectively include a motor, and the motor of the one drive unit and the motor of the other drive unit are disposed in the space between two adjacent throttle shafts out of the plurality of throttle shafts.

With this structure, the motors included in the two drive units to drive the two adjacent throttle shafts are aggregated in the space sandwiched by two throttle shafts, namely two throttle bodies. Therefore, the apparatus becomes further compact in width and size.

In the above-mentioned structure, it is possible to respectively dispose an angle detect sensor at the outer end portion of each of the plurality of throttle shafts to detect the opening angle of the throttle valve.

With this structure, the rotate angle of the throttle shaft supporting the throttle valves for each group is detected by the angle detect sensor. Therefore, the angle of the throttle valves can be adjusted finely and accurately by each drive unit, and the combustion condition, namely the power, can be adequately controlled in accordance with the driving conditions.

In the above-mentioned structure, it is possible to separately control the plurality of drive units in accordance with the driving conditions of the engine.

With this structure, when two drive units are disposed for example, it is possible that one drive unit is controlled based on the accelerator operation, and the other drive unit is controlled in accordance with control signals which are determined based on the driving conditions and the accelerator operation. It is also possible that only one drive unit is controlled for idle-speed-up (fast-idle) at starting. Further, it is also possible to control the drive unit completely separately by respective computers or controllers exclusively prepared for each drive unit. Therefore, starting, controllability, specific fuel consumption, safety, etc. of the engine can be improved.

In the above-mentioned structure, it is possible that at least one of the plurality of drive units is controlled to open and close a throttle valve, and after a specific time, another one of the plurality of drive units is controlled to open and close a throttle valve.

With this structure, since it is possible to suppress rapid revolution speed change of the engine even when the throttle is returned quickly, safe driving is ensured.

In the above-mentioned structure, it is possible that at least one of the plurality of groups of the throttle valves is controlled to be at a specific angle in accordance with the driving conditions of an engine.

The multiple throttle apparatus, in accordance with embodiments of the invention, comprises a plurality of throttle valves respectively disposed at each air intake passage corresponding to each cylinder of an engine and separated into a plurality of groups of throttle valves; a plurality of throttle shafts disposed either in a line or in parallel while supporting to open and close the plurality of throttle valves for each group; and a plurality of drive units to exert a drive force to each of the plurality of throttle shafts and separately controlled in accordance with driving conditions of the engine comprising at least a normal engine operating condition, a non-normal engine operating condition, an abrupt acceleration condition, an abrupt deceleration condition, or an idle speed control condition, or combinations thereof.

In the above-mentioned structure, an angle detect sensor may respectively be disposed at an end portion of each of the plurality of throttle shafts to detect the angle opening of the throttle valve, and in the normal engine operating condition the plurality of drive units for each group are similarly controlled based on a signal from an accelerator angle sensor, in the non-normal engine operating condition one of the plurality of drive units maintains a predetermined valve angle for the respective group of throttle valves and another one of the plurality of drive units is controlled based on a signal from the accelerator angle senor, in the abrupt acceleration condition one of the plurality of drive units is controlled to open the throttle valves of the respective one group and, after a predetermined time, another one of the plurality of drive units is controlled to open the throttle valves of the respective other group, in the abrupt deceleration condition one of the plurality of drive units is controlled to close the throttle valves of the respective one group and, after a predetermined time, another one of the plurality of drive units is controlled to close the throttle valves of the respective other group, and in the idle speed control condition one of the plurality of drive units is controlled to maintain a predetermined valve angle for the respective one group of the throttle valves, and another one of the plurality of drive units is controlled to open or close the throttle valves of the respective other group.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

The embodiments of the present invention are explained below with reference to the drawings.

Figure 1:
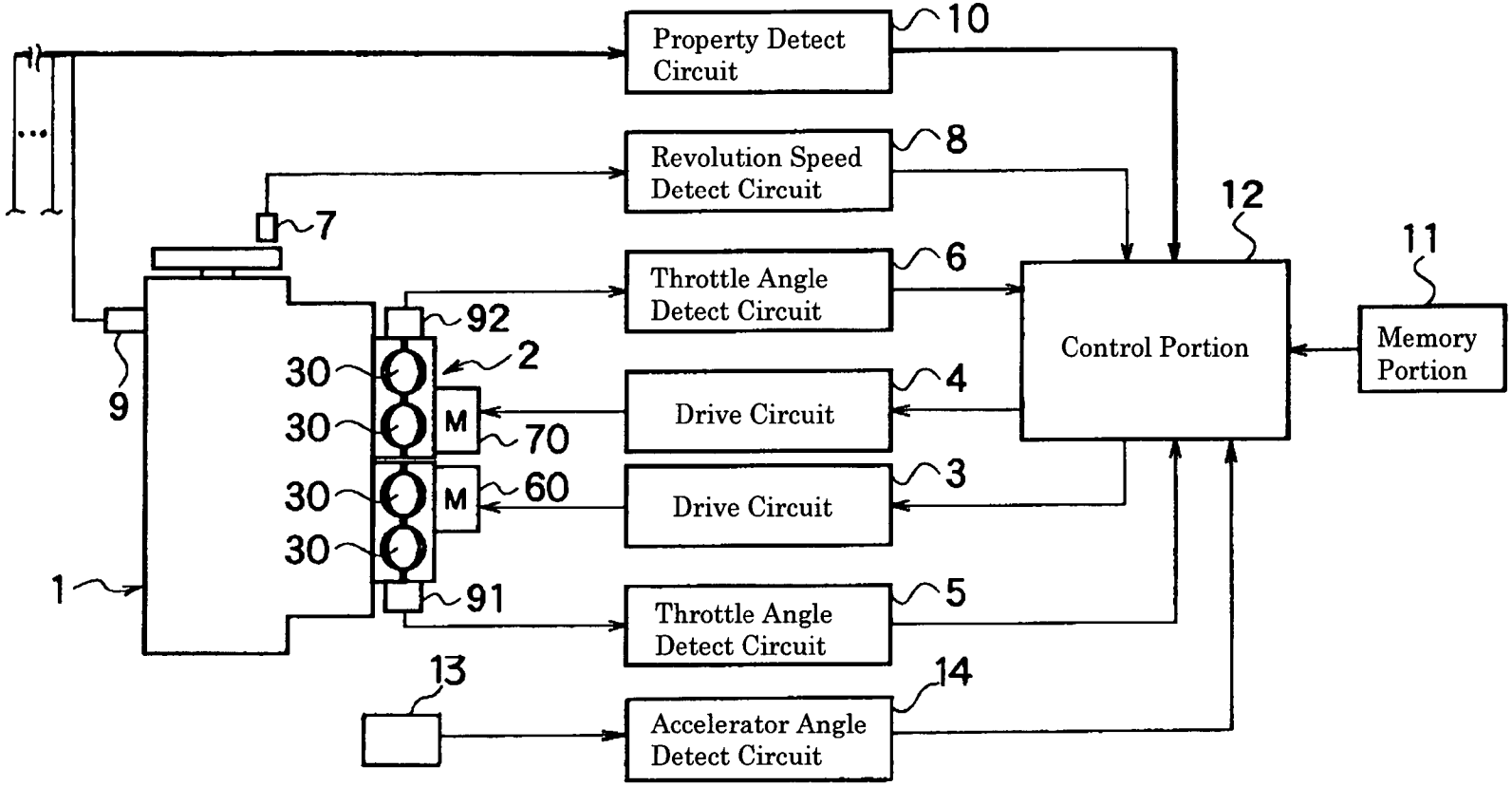
FIG. 1 is a block diagram showing a control system utilizing a multiple throttle apparatus in accordance with embodiments of the present invention.
Figure 2:
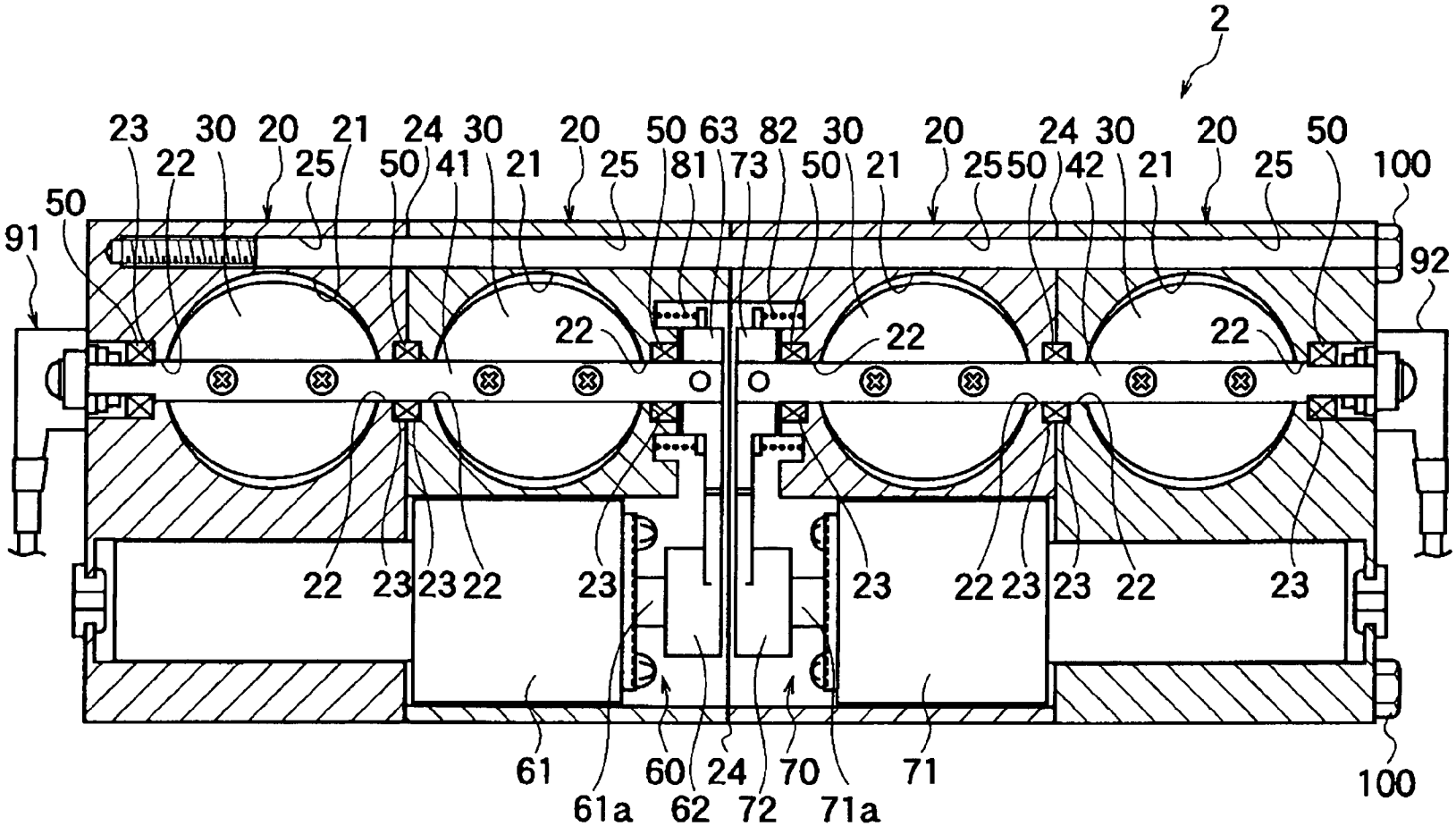
FIG. 2 is an abbreviated schematic drawing showing an embodiment of a multiple throttle apparatus of the present invention.
Figure 3:
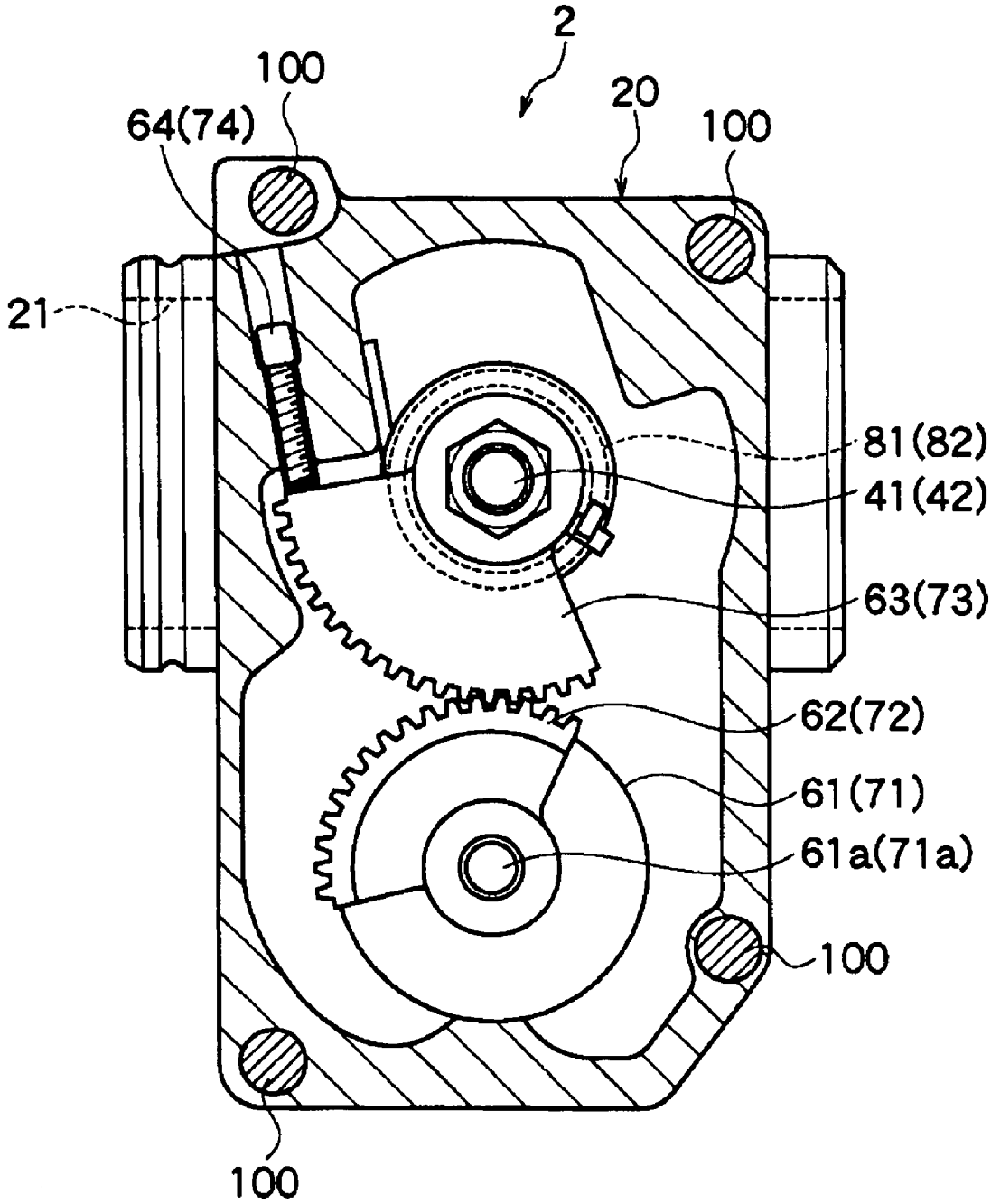
FIG. 3 is a side view showing a drive unit of the apparatus shown in FIG. 1.

FIGS. 1 through 3 show an embodiment of a multiple throttle apparatus of the present invention. FIG. 1 is a block diagram showing a control system utilizing the multiple throttle apparatus for an engine mounted on a motorcycle. FIG. 2 is a sectional view of the apparatus. FIG. 3 is a side view showing a drive unit of the apparatus.

As shown in FIG. 1, the control system comprises an engine 1, a multiple throttle apparatus 2 with throttle valves 30 mounted on an air intake system of the engine 1, drive circuits 3, 4 to respectively drive two drive units 60, 70 (with motors M) disposed at the apparatus 2, angle detect sensors 91, 92 and throttle angle detect circuits 5, 6 to detect the angle position of a throttle valve, a revolution sensor 7 and a revolution speed detect circuit 8 to detect revolution speed of the engine 1, a sensor 9 (a water temperature sensor is shown in the figure) and a property detect circuit 10 to detect another property of the engine 1 (such as water temperature, intake air temperature, intake air pressure of the engine 1, and/or atmospheric pressure around the engine 1), a memory portion 11 having various control information and drive maps, etc. stored in advance, a control portion 12 to control all the system, an accelerator angle sensor 13 and an accelerator angle detect circuit 14 to detect the rotate angle position of an accelerator (e.g., a motorcycle grip) which is operated by a driver, and so on.

The apparatus 2 is a four-barrel throttle apparatus which is utilized for a straight four cylinder engine. As shown in FIG. 2, the apparatus 2 comprises four throttle bodies 20 to form air intake passages 21, four throttle valves 30 with each valve 30 disposed respectively to a corresponding intake passage 21, a first throttle shaft 41 and a second throttle shaft 42, bearings 50, a first drive unit 60 and a second drive unit 70, a first return spring 81 and a second return spring 82, a first angle detect sensor 91 and a second angle detect sensor 92, a connect bolt 100, and so on.

The throttle body 20 preferably is molded of aluminum material or resin material. As shown in FIG. 2, the throttle body 20 has an air intake passage 21 which section is approximately circular, a through-hole 22 through which the respective throttle shafts 41, 42 pass, a concave fit portion 23 to which the bearing 50 fits, a joint surface 24, a bolt hole 25 through which the connect bolt 100 passes, and so on. The through hole 22 is formed to be slightly larger than the diameter of the first throttle shaft 41 and that of the second throttle shaft 42 to prevent any contact.

As shown in FIG. 2, the first throttle shaft 41 and the second throttle shaft 42 are arranged in a line. Then, the first throttle shaft 41 rotatably supports to simultaneously open and close the two throttle valves 30 of the left side which is designated as the first group. The second throttle shaft 42 rotatably supports to simultaneously open and close the two throttle valves 30 of the right side which is designated as the second group.

The bearing 50 is disposed at both sides to sandwich each throttle valve 30. Therefore, the throttle shafts 41, 42 rotate smoothly without twisting etc, and the synchronization (open and close operation at the same phase) of the throttle valves between the groups is ensured. For the bearing 50, it is possible to adopt various types of bearing, such as a ball bearing, a roller bearing, a bush bearing which the contact face itself functions as a bearing, and so on. Further, at least a part of the plurality of bearings 50 supports not only in the radial direction but also in the thrust direction.

As shown in FIG. 2 and FIG. 3, the first drive unit 60 has a DC motor 61, a gear 62 fixed to an output shaft 61*a*, a gear 63 fixed at an inner end portion of the first throttle shaft 41 and meshed with the gear 62, and an adjust screw 64 to adjust the stop position of the gear 63.

The first return spring 81 is disposed at the vicinity of the gear 63, and urges the first throttle shaft 41 in the rotating direction to return the two throttle valves 30 of the first group toward the rest position of the closing side.

When the DC motor 61 rotates from the rest state, the first throttle shaft 41 rotates via the gear 62 and the gear 63 against the urge force of the first return spring 81. Then, the two throttle valves 30 of the first group open the air intake passage 21. On the other hand, when the powering to the DC motor 61 is discontinued, the first throttle shaft 41 rotates in the opposite direction by the urging force of the first return spring 81, and the two throttle valves 30 of the first group return to the rest position of the closing side.

As shown in FIG. 2 and FIG. 3, the second drive unit 70 has a DC motor 71, a gear 72 fixed to an output shaft 71*a*, a gear 73 fixed at an inner end portion of the second throttle shaft 42 and meshed with the gear 72, and an adjust screw 74 to adjust the stop position of the gear 73.

The second return spring 82 is disposed at the vicinity of the gear 73, and urges the second throttle shaft 42 in the rotating direction to return the two throttle valves 30 of the second group toward the rest position of the closing side.

When the DC motor 71 rotates from the rest state, the second throttle shaft 42 rotates via the gear 72 and the gear 73 against the urge force of the second return spring 82. Then, the two throttle valves 30 of the second group open the air intake passage 21. On the other hand, when the powering to the DC motor 71 is discontinued, the second throttle shaft 42 rotates in the opposite direction by the urging force of the second return spring 82, and the two throttle valves 30 of the second group return to the rest position of the closing side.

As mentioned above, the first drive unit 60 and the second drive unit 70 include a gear train, and are disposed to exert drive force to the inner end portions where the first throttle shaft 41 and the second throttle shaft 42 face each other. Therefore, these parts are aggregated around the center range, and the apparatus 2 becomes compact in width and size.

As shown in FIG. 2, the first angle detect sensor 91 and the second angle detect sensor 92 are non-contact type sensors disposed at each outer end portion of the first throttle shaft 41 and the second throttle shaft 42. The sensors detect the rotate angle position of the throttle shafts 41, 42, namely the rotate angle position of the throttle valves 30 of the first group and the rotate angle position of the throttle valves 30 of the second group, and output the detect signals to the control portion 12 via the angle detect circuits 5, 6.

Next, operations and related control of the above-mentioned multiple throttle apparatus are explained.

In normal drive mode, the DC motors 61, 71 rotate in one direction in accordance with the control signal from the control portion 12. The rotate drive force is transmitted to the first throttle shaft 41 and the second throttle shaft 42 via the respective gears 62, 63 and gears 72, 73. Then, the first throttle shaft 41 and the second throttle shaft 42 start to rotate in one direction. The throttle valves 30 of the first group and the second group rotate from the rest position in the direction to open the air intake passage 21.

On the contrary, when the DC motors rotate in the opposite direction based on the control signal from the control portion 12, the first throttle shaft 41 and the second throttle shaft 42 also rotate in the opposite direction while receiving the urging force of the return spring 81, 82. Then the throttle valves 30 of the first group and the second group rotate from the full-open position in the direction to close the air intake passage 21. Here, when the powering to the DC motors 61, 71 is discontinued, the first throttle shaft 41 and the second throttle shaft 42 quickly rotate by the urging force of the return springs 81,82, and return the throttle valves 30 of the first group and the second group to the rest position.

Consequently, in a normal drive mode, DC motors 61, 71 are simultaneously controlled in accordance with the driving conditions, etc. That is, the throttle valves 30 of the first group and the second group are simultaneously controlled to be at an adequate opening in accordance with the signal of the accelerator angle sensor 13.

In a mode other than the normal drive mode, when air amount to all cylinders of an engine is simultaneously controlled by the throttle valves, tiny changes in the throttle valve angle cause large increases of air amount provided to the engine. Therefore, it is difficult to provide adequate air amount unless the small angle of the throttle valves is precisely controlled. For this reason, the air amount to all cylinders is not simultaneously controlled by the same throttle valves. For example, one DC motor 61 is controlled to keep the two throttle valves 30 of the left side which belong to the first group at a constant opening, and the other DC motor 71 is controlled to open and close the throttle valves 30 of the right side which belong to the second group. Namely, the air amount is adjusted by the throttle valves of each group. In this case, since the opening of the throttle valves of one group is previously kept constant, the sensitivity of the increase of the air amount to the engine can be suppressed and adequate air amount can be provided, compared with the case that the air amount to all cylinders of the engine is controlled simultaneously with the same valves. As a result, cost can be suppressed because the performance of the A/D converter and the angle sensor does not necessarily have to be high.

In addition, the combustion condition of each cylinder of an engine differs from each other due to the cooling conditions of the engine and the difference of the length of the exhaust pipes. Therefore, when one DC motor 61 is controlled to keep the two throttle valves 30 of the left side which belong to the first group at a constant opening, and the other DC motor 71 is controlled to open and close the throttle valves of the right side which belong to the second group, adequate air amount can be supplied to each cylinder which has different combustion characteristics in accordance with the combustion condition.

Further, when the opening of the throttle valves 30 of the first group and the second group is at maximum, and the vehicle quickly accelerates, the driver, etc. may have a possibility of not being able to drive safely due to a quick torque increase phenomenon. In such a case, one DC motor 61 is controlled to keep the opening of the throttle valves 30 of the left side which is the first group at the opening before the acceleration, and the other DC motor 71 is controlled to open and close the throttle valves 30 of the right side which is the second group in accordance with the acceleration. In this case, since the air amount supplied to the engine is controlled for each group, the quick torque increase phenomenon is eased and the driver etc. can be ensured of safe driving without having the influence of the quick acceleration.

Meanwhile, in an idle operation condition, only the DC motor 61, for example, is adequately controlled based on the drive signal from the control portion 12. In this case, fine adjustment of the first throttle shaft 41, namely the opening of the throttle valves 30 of the first group, is performed.

To perform ISC of an engine without having a separate ISC valve by adjusting all cylinders simultaneously with the same throttle valves, extremely fine adjustment of the valve opening is needed to follow the target of idle revolution speed changes. In this case, the performance of the A/D converter and the angle sensor has to be high. Here, as mentioned above, one DC motor 61 is controlled to keep the two throttle valves 30 of the left side as the first group at a constant opening, and the other DC motor 71 is controlled to open and close the throttle valves 30 of the right side as the second group. In this case, since the opening of the throttle valves of one group is previously kept constant, compared to the case of adjusting by the same throttle valves, it is easier to supply adequate air amount in accordance with the target of idle revolution speed changes without fine adjusting of the valve opening. Then, cost reduction can be achieved because the performance of the A/D converter and the angle sensor does not necessarily have to be high. In this manner, even in the case of performing ISC, controlling to open and close the throttle valves 30 by each group is made possible.

Further, when rapid returning of the throttle is performed, for example, after one of the DC motors 61, 71 is driven in the opposite direction, the other is driven in the opposite direction based on the drive signal of the control portion 12. Namely, after the throttle valves 30 of one group close, the throttle valves 30 of the other group close sequentially. In this manner, by driving the throttle valves 30 for each group with a time difference, rapid revolution change of the engine 1 is suppressed, and safe driving can be ensured while preventing nose-dive, slip, overturning, etc.

On the contrary, when the vehicle quickly accelerates, after one of the DC motors 61, 71 is driven, the other motor is driven based on the control signal of the control portion 12. Namely, after the throttle valves 30 of one group open, the throttle valves 30 of the other group open sequentially. In this manner, other than controlling the opening of one group constantly, by driving the throttle valves 30 for each group with a time difference, rapid revolution change of the engine 1 is suppressed, and the driver, etc. can be ensured of safe driving without having the influence of the quick acceleration.

Figure 4:
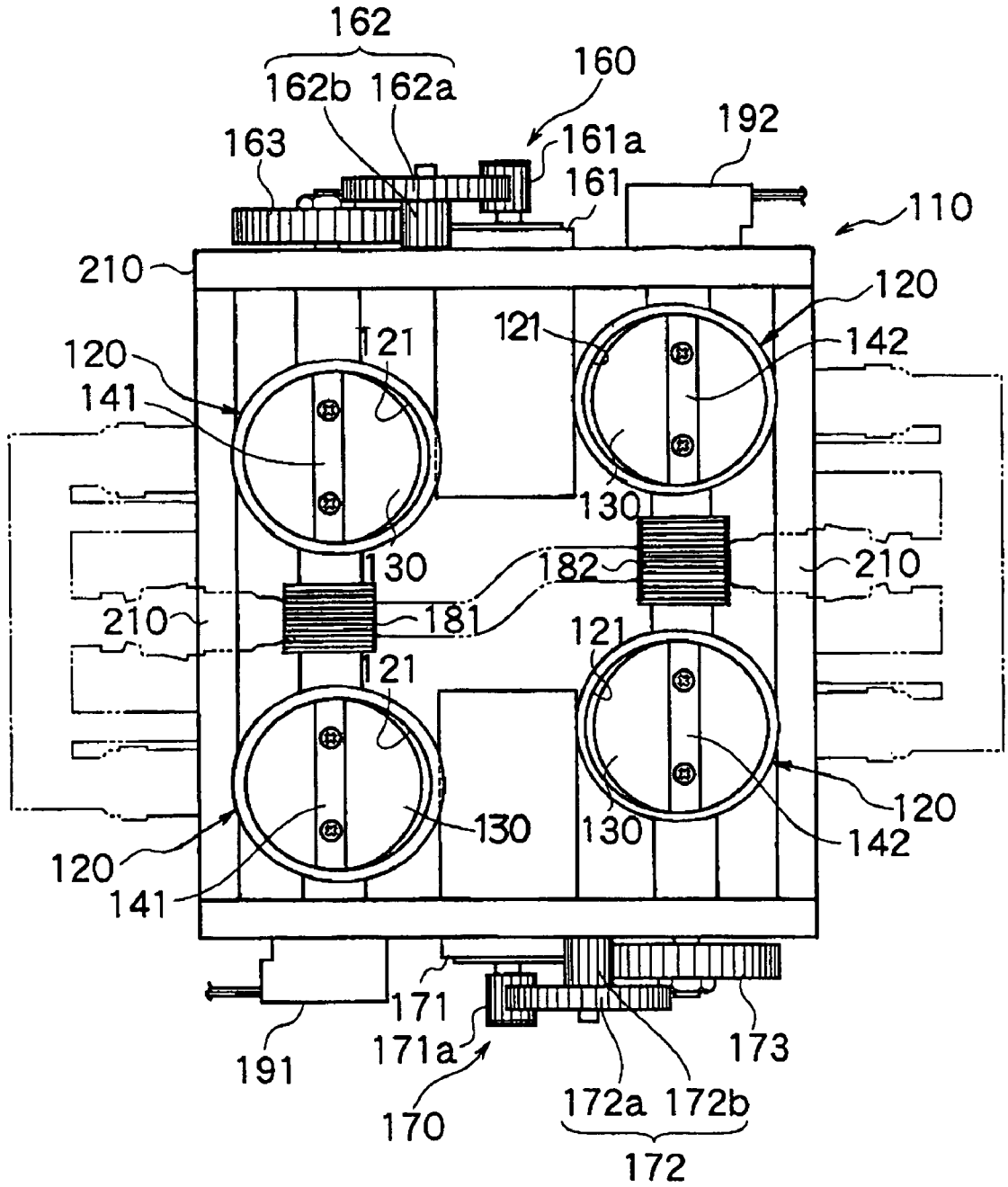
FIG. 4 is an abbreviated schematic drawing showing another embodiment of a multiple throttle apparatus of the present invention.
Figure 5:
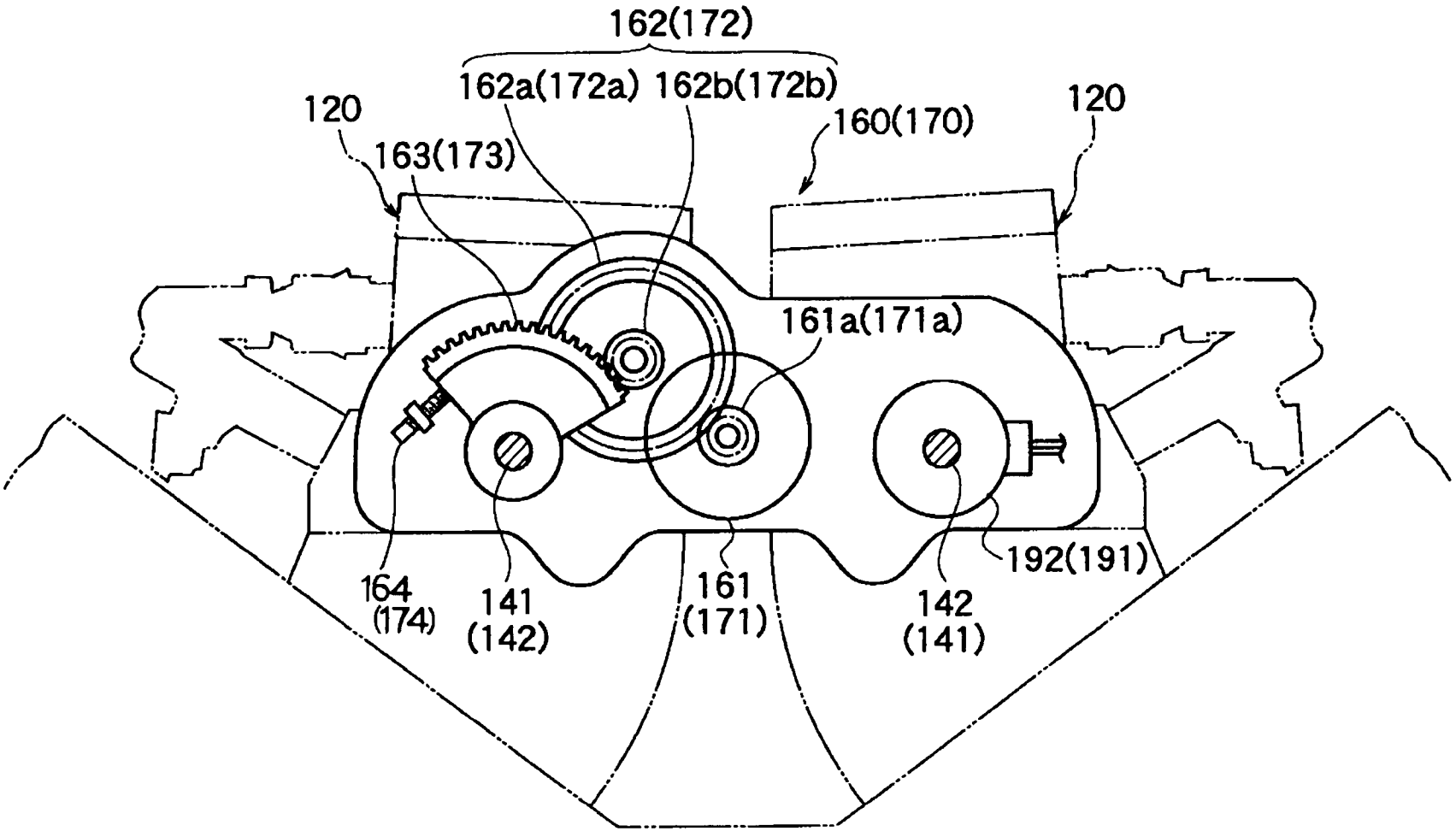
FIG. 5 is a side view showing a drive unit of the apparatus shown in FIG. 4.
Figure 6:
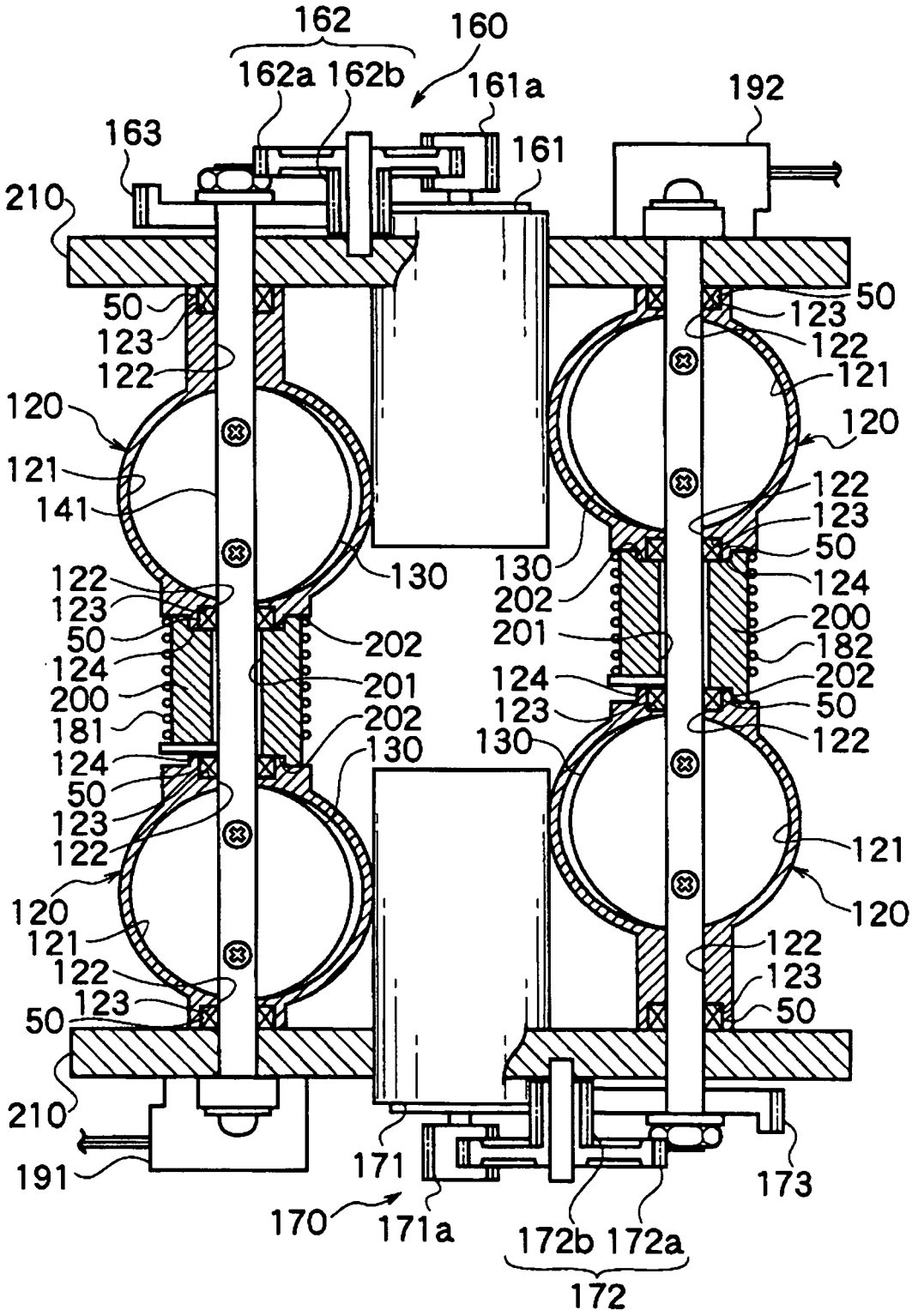
FIG. 6 is plain sectional view of the apparatus shown in FIG. 4.

FIGS. 4 through 6 show another embodiment of a multiple throttle apparatus of the present invention. Here, the control system for this apparatus is the same as that shown in FIG. 1 for the apparatus of the previous embodiment.

The apparatus 110 is a four-barrel throttle apparatus which is utilized for a V-type four cylinder engine. As shown in FIG. 4 and FIG. 6, the apparatus 110 comprises four throttle bodies 120 to form air intake passages 121, four throttle valves 130 disposed respectively to each intake passage 121, a first throttle shaft 141 and a second throttle shaft 142, bearings 50 which is the same as mentioned before, a first drive unit 160 and a second drive unit 170, a first return spring 181 and a second return spring 182, a first angle detect sensor 191 and a second angle detect sensor 192, a spacer 200, a connect plate 210, and so on.

The throttle body 120 preferably is molded of aluminum material or resin material. As shown in FIG. 4 and FIG. 6, the throttle body 120 has the air intake passage 121 which section is approximately circular, a through-hole 122 through which respective throttle shafts 141, 142 pass, a concave fit portion 123 to which the bearing 50 fits, a joint convex portion 124, and so on. The through hole 122 is formed to be slightly larger than the diameter of the first throttle shaft 141 and that of the second throttle shaft 142 to prevent any contact.

Further, two throttle bodies 120 of the left side and two throttle bodies 120 of the right side are respectively connected via spacer 200. Then, connect plate 210 connects the entire apparatus firmly. Here, the spacer 200 has a through-path 201 and a fit concave portion 202, as shown in FIG. 6.

As shown in FIG. 4 and FIG. 6, the first throttle shaft 141 and the second throttle shaft 142 are disposed in parallel with a specific space. Then, the first throttle shaft 141 rotatably supports to simultaneously open and close the two throttle valves 130 of the left side as the first group. The second throttle shaft 142 rotatably supports to simultaneously open and close the two throttle valves 130 of the right side as the second group.

Further, like a straight four cylinder engine, with a V-type engine, the combustion characteristic differs from each other depending on a bank, a cylinder, cooling conditions of the engine, and the length of the exhaust pipe. Therefore, for example, the first drive unit 160 is to be controlled to exert drive force to the first throttle shaft 141 which is disposed at the front-bank of the front wheel side of the vehicle. Then, the second drive unit 170 is to be controlled to exert drive force to the second throttle shaft 142 which is disposed at the rear-bank of the rear wheel side of the vehicle. In this manner, by driving each throttle shaft separately, it is possible to supply adequate air amount to each cylinder group which has different combustion characteristics.

As shown in FIGS. 4 through 6, the first drive unit 160 is disposed at one end side of the first throttle shaft 141 and the second throttle shaft 142 (one end side of the apparatus 110). The first drive unit 160 has a DC motor 161, a pinion 161*a* fixed to an output shaft, a gear 162 (a large gear 162*a*, a small gear 162*b*), a gear 163 fixed to an end portion of the first throttle shaft 141 and meshed with the gear 162 (the small gear 162*b*), and an adjust screw 164 to adjust the stop position of the gear 163.

The DC motor 161 is disposed between the first throttle shaft 141 and the second throttle shaft 142, namely at the space sandwiched by the throttle bodies 120 of the left side and the right side.

The first return spring 181 is disposed approximately at the center of the first throttle shaft 141, and urges the first throttle shaft 141 in the rotating direction to return the two throttle valves 130 of the first group toward the rest position of the closing side.

When the DC motor 161 rotates from the rest state, the first throttle shaft 141 rotates via the gear 162 and the gear 163 against the urge force of the first return spring 181. Then, the two throttle valves 130 of the first group rotate in the direction to open the air intake passage 121. On the other hand, when the powering to the DC motor 161 is discontinued, the first throttle shaft 141 rotates in the opposite direction by the urging force of the first return spring 181, and the two throttle valves 130 of the first group return to the rest position of the closing side.

As shown in FIGS. 4 through 6, the second drive unit 170 is disposed at the other end side of the first throttle shaft 141 and the second throttle shaft 142 (the other end side of the apparatus 110). The second drive unit 170 has a DC motor 171, a pinion 171*a* fixed to an output shaft, a gear 172 (a large gear 172*a*, a small gear 172*b*), a gear 173 fixed to an end portion of the second throttle shaft 142 and meshed with the gear 172 (the small gear 172*b*), and an adjust screw 174 to adjust the stop position of the gear 173.

The DC motor 171 is disposed between the first throttle shaft 141 and the second throttle shaft 142, namely at the space sandwiched by the throttle bodies 120 of the left side and the right side.

The second return spring 182 is disposed approximately at the center of the second throttle shaft 142, and urges the second throttle shaft 142 in the rotating direction to return the two throttle valves 130 of the second group toward the rest position of the closing side.

When the DC motor 171 rotates from the rest state, the second throttle shaft 142 rotates via the gear 172 and the gear 173 against the urge force of the second return spring 182. Then, the two throttle valves 130 of the second group rotate in the direction to open the air intake passage 121. On the other hand, when the powering to the DC motor 171 is discontinued, the second throttle shaft 142 rotates in the opposite direction by the urging force of the second return spring 182, and the two throttle valves 130 of the second group return to the rest position of the closing side.

As mentioned above, the first drive unit 160 and the second drive unit 170 include a gear train, and are disposed in good balance at both sides of the first throttle shaft 141 and the second throttle shaft 142. Therefore, the apparatus 110 becomes compact in width and size. Furthermore, since the DC motors 161, 171 are disposed at the space sandwiched by the throttle bodies 120, the parts are aggregated around the center range, and the apparatus 110 is downsized further.

As shown in FIG. 4 and FIG. 6, the first angle detect sensor 191 and the second angle detect sensor 192 are non-contact type sensors disposed at each other end portion of the first throttle shaft 141 and the second throttle shaft 142. The sensors detect the rotate angle position of the throttle shafts 141, 142, namely the rotate angle position of the throttle valves 130 of the first group and the rotate angle position of the throttle valves 130 of the second group, and output the detect signals to the control portion 12 via the angle detect circuits 5, 6 which are mentioned before.

Here, the control of the apparatus 110 is the same as for the apparatus of the above-mentioned first embodiment. Therefore, further explanation is unnecessary and not provided.

In the above-mentioned embodiment, a four-barrel throttle apparatus is shown as the multiple throttle apparatus. However, the present invention is not limited to this, and a multiple throttle apparatus such as two-barrel, three-barrel, five-barrel or more can adopt the structure of the present invention in accordance with further embodiments thereof.

Further, in the above-mentioned embodiment, a structure including a gear train is shown as part of the drive unit. However, the present invention is not limited to this, and it is also possible to adopt other drive mechanisms, such as chain driving, belt driving and so on, for use as part of the drive units.

Furthermore, in the above-mentioned embodiment, an engine mounted on a motorcycle is shown as an engine to utilize a multiple throttle apparatus of the present invention. However, the present invention is not limited to this, and a high performance engine mounted on an automobile or other vehicle is also possible to adopt a multiple throttle apparatus of the present invention in accordance with further embodiments thereof.

As mentioned above, with the multiple throttle apparatus according to embodiments of the present invention, a plurality of throttle valves which are respectively disposed at each air intake passage corresponding to each cylinder of an engine are supported by and associated with a plurality of throttle shafts by separating the throttle valves into groups, and a plurality of drive units are disposed to respectively drive the plurality of throttle shafts. In this manner, the throttle valves can be driven to open and close by each group. In addition, by controlling the plurality of drive units separately, the combustion condition, namely the power, can adequately be controlled in accordance with the driving conditions. For example, for the above described embodiments, driving conditions of the engine comprised at least a normal engine operating condition, a non-normal engine operating condition, an abrupt acceleration condition, an abrupt deceleration condition, or an idle speed condition, or combinations thereof. In the normal engine operating condition the plurality of drive units for each group are similarly controlled based on a signal from an accelerator angle senor, in the non-normal engine operating condition one of the plurality of drive units maintains a predetermined valve angle for the respective group of throttle valves and another one of the plurality of drive units is controlled based on a signal from the accelerator angle senor, in the abrupt acceleration condition one of the plurality of drive units is controlled to open the throttle valves of the respective one group and, after a predetermined time, another one of the plurality of drive units is controlled to open the throttle valves of the respective other group, in the abrupt deceleration condition one of the plurality of drive units is controlled to close the throttle valves of the respective one group and, after a predetermined time, another one of the plurality of drive units is controlled to close the throttle valves of the respective other group, and in the idle speed control condition one of the plurality of drive units is controlled to maintain a predetermined valve angle for the respective one group of the throttle valves, and another one of the plurality of drive units is controlled to open or close the throttle valves of the respective other group. However, it can be seen also that the plurality of drive units and respective groups of throttle valves could be controlled in accordance with additional driving conditions not described above.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A multiple throttle apparatus, comprising:

a plurality of throttle valves respectively disposed at each air intake passage corresponding to each cylinder of an engine, a throttle shaft supporting to open and close said plurality of throttle valves, and a drive unit to rotate said throttle shaft, wherein said plurality of throttle valves are separated into a plurality of groups, wherein said throttle shaft includes a plurality of throttle shafts disposed in a line while supporting said throttle valves for each group, and wherein said drive unit includes a plurality of drive units being centrally disposed to exert drive force to the inner center end portion of the side where said plurality of throttle shafts face each other.

2. The multiple throttle apparatus according to claim 1, wherein an angle detect sensor is respectively disposed at the outer end portion of each of said plurality of throttle shafts to detect the opening angle of said throttle valve.

3. The multiple throttle apparatus according claim 1, wherein said plurality of drive units are separately controlled in accordance with driving conditions of the engine.

4. The multiple throttle apparatus according to claim 1, wherein at least one of said plurality of drive units is controlled unit to open and close a throttle valve, and after a specific time, another one of said plurality of drive units is controlled to open and close a throttle valve.

5. The multiple throttle apparatus according to claim 1, wherein at least one of said plurality of groups of said throttle valves is controlled to be at a specific angle in accordance with driving conditions of the engine.

6. The multiple throttle apparatus according to claim 5, wherein said specific angle is the angle to which the throttle valve is controlled while revolution speed of the engine is low.

7. A multiple throttle apparatus, comprising:

a plurality of throttle valves respectively disposed at each air intake passage corresponding to each cylinder of an engine, a throttle shaft supporting to open and close said plurality of throttle valves, and a drive unit to rotate said throttle shaft, wherein said plurality of throttle valves are separated into a plurality of groups, wherein said throttle shaft includes a plurality of throttle shafts each located on a different cylinder bank and disposed in parallel while supporting said throttle valves for each group, wherein said drive unit includes a plurality of drive units, each having a gear train located outside of a connect plate enclosing the throttle apparatus, to exert drive force to each of said plurality of throttle shafts, and wherein one drive unit of said plurality of drive units is disposed to exert drive force to an end portion of one throttle shaft at one end side of two adjacent throttle shafts of said plurality of throttle shafts, and another drive unit of said plurality of drive units is disposed to exert drive force to an end portion of the other throttle shaft at the other end side of the two adjacent throttle shafts of said plurality of throttle shafts.

8. The multiple throttle apparatus according to claim 7, wherein said plurality of drive units respectively include a motor, and the motor of said one drive unit and the motor of said other drive unit are disposed in the space between two adjacent throttle shafts of said plurality of throttle shafts.

9. The multiple throttle apparatus according to claim 7, wherein an angle detect sensor is respectively disposed at the outer end portion of each of said plurality of throttle shafts to detect the opening angle of said throttle valve.

10. The multiple throttle apparatus according claim 7, wherein said plurality of drive units are separately controlled in accordance with driving conditions of the engine.

11. The multiple throttle apparatus according to claim 7, wherein at least one of said plurality of drive units is controlled to open and close a throttle valve, and after a specific time, another one of the plurality of drive units is controlled to open and close a throttle valve.

12. The multiple throttle apparatus according to claim 7, wherein at least one of said plurality of groups of said throttle valves is controlled to be at a specific angle in accordance with driving conditions of the engine.

13. The multiple throttle apparatus according to claim 12, wherein said specific angle is the angle to which the throttle valve is controlled while revolution speed of the engine is low.

14. A multiple throttle apparatus, comprising:

a plurality of throttle valves respectively disposed at each air intake passage corresponding to each cylinder of an engine and separated into a plurality of groups of throttle valves;

a plurality of throttle shafts disposed either in a line or in parallel while supporting to open and close said plurality of throttle valves for each group; and a plurality of drive units to exert a drive force to each of said plurality of throttle shafts and separately controlled in accordance with driving conditions of the engine comprising at least a normal engine operating condition, a non-normal engine operating condition, an abrupt acceleration condition, an abrupt deceleration condition, or an idle speed control condition, or combinations thereof, wherein an angle detect sensor is respectively disposed at an end portion of each of said plurality of throttle shafts to detect the angle opening of said throttle valve, and wherein in the normal engine operating condition the plurality of drive units for each group are similarly controlled based on a signal from an accelerator angle sensor, in the non-normal engine operating condition one of the plurality of drive units maintains a predetermined valve angle for the respective group of throttle valves and another one of the plurality of drive units is controlled based on a signal from the accelerator angle sensor, in the abrupt acceleration condition one of the plurality of drive units is controlled to open the throttle valves of the respective one group and, after a predetermined time another one of the plurality of drive units is controlled to open the throttle valves of the respective other group, in the abrupt deceleration condition one of the plurality of drive units is controlled to close the throttle valves of the respective one group and, after a predetermined time, another one of the plurality of drive units is controlled to close the throttle valves of the respective other group, and in the idle speed control condition one of the plurality of drive units is controlled to maintain a predetermined valve angle for the respective one group of the throttle valves, and another one of the plurality of drive units is controlled to open or close the throttle valves of the respective other group.

15. The multiple throttle apparatus according to claim 14, wherein the plurality of drive units are disposed to exert drive force to the inner end portion of the side where said plurality of throttle shafts face each other when disposed in a line.

16. The multiple throttle apparatus according to claim 14, wherein one drive unit of the plurality of drive units is disposed to exert a drive force to an end portion of one throttle shaft at one end side of two adjacent throttle shafts of said plurality of throttle shafts when disposed in parallel, and another drive unit of the plurality of drive units is disposed to exert a drive force to an end portion of the other throttle shaft at the other end side of the two adjacent throttle shafts of said plurality of throttle shafts.

17. The multiple throttle apparatus according to claim 16, wherein said plurality of drive units respectively include a motor, and the motor of said one drive unit and the motor of said other drive unit are disposed in the space between two adjacent throttle shafts of said plurality of throttle shafts.

* * * * *

UNITED STATES PATENT AND TRADEMARK OFFICE

CERTIFICATE OF CORRECTION

PATENT NO. : 7,066,142 B2
APPLICATION NO. : 11/077293
DATED : June 27, 2006
INVENTOR(S) : Maki Hanasato It is certified that error appears in the above-identified patent and that said Letters Patent is hereby corrected as shown below:

Column 14, line 20, change “time” to --time,--

Signed and Sealed this

Sixth Day of March, 2007

JON W. DUDAS
*Director of the United States Patent and Trademark Office*